US008666106B2

(12) United States Patent
Konno et al.

(10) Patent No.: US 8,666,106 B2
(45) Date of Patent: Mar. 4, 2014

(54) SOUND REPRODUCING DEVICE

(75) Inventors: Fumiyasu Konno, Osaka (JP); Katsu Takeda, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/616,224

(22) Filed: Sep. 14, 2012

(65) Prior Publication Data

US 2013/0077803 A1 Mar. 28, 2013

(30) Foreign Application Priority Data

Sep. 22, 2011 (JP) ..... 2011-206923

(51) Int. Cl.
*H04R 1/02* (2006.01)

(52) U.S. Cl.
USPC ..... 381/387; 381/107; 381/332; 381/333; 381/111; 381/300; 381/306; 381/386; 381/388

(58) Field of Classification Search
USPC ..... 381/387, 107, 300, 306, 332, 333, 386, 381/388, 17; 348/231.4, 207.99, 738, 423.1
See application file for complete search history.

(56) References Cited

U.S. PATENT DOCUMENTS

| | | | |
|---|---|---|---|
| 6,807,281 | B1 | 10/2004 | Sasaki et al. |
| 2007/0217616 | A1 | 9/2007 | Miyazaki |
| 2008/0159571 | A1 | 7/2008 | Hooley |
| 2010/0027832 | A1* | 2/2010 | Koseki ..... 381/387 |
| 2010/0226499 | A1 | 9/2010 | De Bruijn et al. |

FOREIGN PATENT DOCUMENTS

| | | | |
|---|---|---|---|
| JP | 04-351197 | A | 12/1992 |
| JP | 2001-025084 | A | 1/2001 |
| JP | 2002-027586 | A | 1/2002 |
| JP | 2005-159446 | A | 6/2005 |
| JP | 2010-039094 | A | 2/2010 |
| JP | 2010-039333 | A | 2/2010 |
| JP | 2011-033993 | A | 2/2011 |
| WO | WO-2006/057131 | A1 | 6/2006 |

OTHER PUBLICATIONS

Extended European Search Report dated Feb. 22, 2013 issued in corresponding EP Patent Application No. 12185198.4.
Chinese Office Action in Chinese Patent Application No. 201210355706.0 with issuing date Jul. 18, 2013.

* cited by examiner

*Primary Examiner* — Xu Mei
*Assistant Examiner* — Paul Kim
(74) *Attorney, Agent, or Firm* — McDermott Will & Emery LLP

(57) ABSTRACT

A sound reproducing device includes parametric speakers disposed to a display, a loudspeaker, drivers, a human-body sensor, and a controller. The loudspeaker has a wider directivity than the parametric speakers. The drivers change directions of the parametric speakers, respectively. The parametric speakers and the drivers constitute at least two parametric speaker units each composed of respective one of the parametric speakers and respective one of the drivers. The controller reproduces sound information based the number of persons in front of the display detected from an output from the human-body senor. The sound reproducing device reduces the possibility for a number of persons to hear the sound noisily, and allows drawing more attention to the content, e.g. an advertisement.

23 Claims, 5 Drawing Sheets

SOUND REPRODUCING DEVICE

FIELD OF INVENTION

The present invention relates to a sound reproducing device employing a parametric speaker.

BACKGROUND OF INVENTION

In recent years, display devices to be used for advertisement have been developed, and these devices employ large screen displays. This display device allows using an animation for advertisement, so that the advertisement can draw more attentions. Reproduction of sound information such as voice, music, and effective sound allows drawing still more attentions to the advertisement. However, the sound information sometimes sounds noisily to passers-by.

To overcome this problem, a sound output control device, i.e. a sound reproducing device, has been proposed. This device employs an ultra-directional speaker (called as a parametric speaker) that gives a directivity to sound information, so that the sound information can be delivered only to a specific target. Japanese Patent Laid-Open Publication No. 2010-39094 discloses a conventional sound output control device, sound reproducing device. FIG. 5 is a perspective view of the conventional sound reproducing device.

Display device 101 that displays an advertise image includes display panel 103 implemented by a flat panel display, such as an LCD panel. Display device 101 is equipped with ultra-directional speaker 105 and camera 107 mounted to the upper end of device 101. Speaker 105 is supported by speaker pedestal 109 which includes a motor (not shown) so that an output direction of sound can be changed horizontally or vertically as indicated by the arrows shown in FIG. 5. Display device 101, ultra-directional speaker 105, camera 107, and speaker pedestal 109 are connected to a controller (not shown).

The above patent literature discloses that the controller detects persons captured by camera 107 as targets, and causes speaker pedestal 109 to adjust a direction of sound output from speaker 105 to be directed toward the targets, and then ultra-directional speaker 105 outputs the sound. As a result, the sound output from ultra-directional speaker 105 allows calling more attention to the advertisement from the persons within a range allowing the advertisement to be recognized.

The sound output control device shown in FIG. 5 allows ultra-directional speaker 105 to output a sharp directional sound to the targets captured by camera 107, so that only the specific targets can pay attention with the aid of the sound to the advertisement. As a result, the control device can reduce the possibility for the passers-by other than the targets to hear the sound noisily. On the other hand, since the sound has a sharp directivity, the sound may not delivered to passers-by other than the specified targets, so that the advertisement cannot fully draw attention from people.

SUMMARY OF INVENTION

A sound reproducing device includes parametric speakers disposed to a display, a loudspeaker, drivers, a human-body sensor, and a controller. The loudspeaker has a wider directivity than the parametric speakers. The drivers change directions of the parametric speakers, respectively. The parametric speakers and the drivers constitute at least two parametric speaker units each composed of respective one of the parametric speakers and respective one of the drivers are disposed.

The controller reproduces sound information based the number of persons in front of the display detected from an output from the human-body senor.

The sound reproducing device reduces the possibility for a number of persons to hear the sound noisily, and allows drawing more attention to the content, e.g. an advertisement.

DETAIL DESCRIPTION OF PREFERRED EMBODIMENTS

Exemplary Embodiment 1

Figure 1:
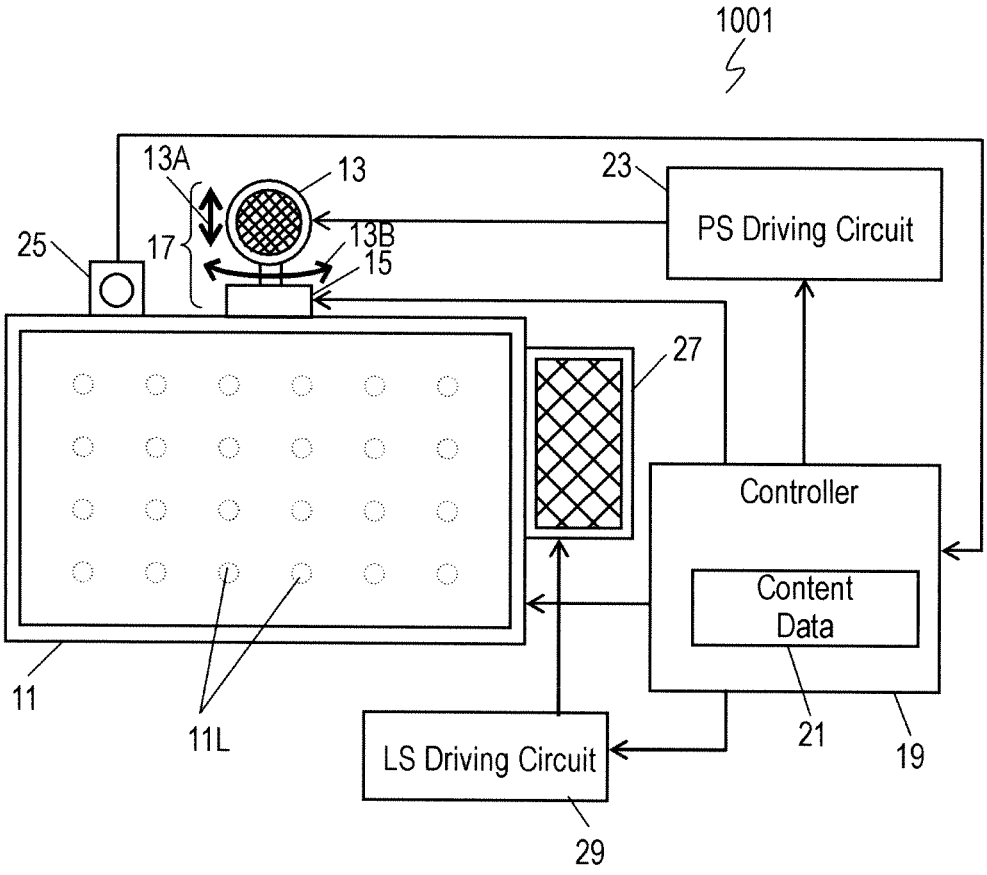
FIG. 1 is a schematic view of a sound reproducing device in accordance with Exemplary Embodiments 1 and 2 of the present invention.

FIG. 1 is a schematic view of sound reproducing device 1001 in accordance with Exemplary Embodiment 1 of the present invention.

In FIG. 1, display 11 is a flat panel display of self-luminous type or a backlight type, and displays the content of advertisement statically or dynamically. Display 11 includes equipped with light source 11L, so that it can draw more visual attention. Display 11 is placed at a shop front or on a wall along a street in order to draw more attention of a number of people.

Parametric speaker 13 is disposed to display 11.

Parametric speaker 13 included in sound reproducing device 1001 reproduces audible sounds. The sound pressure of the audible sound has a peak along a sound axis at a predetermined distance from parametric speaker 13. Parametric speaker 13 utilizes an ultrasonic wave as a carrier wave. When parametric speaker 13 radiates a component of the audible sounds by superimposing the component on the ultrasonic wave, the waveform of the ultrasonic wave as a carrier wave is affected by nonlinearity of elastic characteristics of air, so that the waveform is distorted as transmitting in the air, and simultaneously, a higher-frequency component of the ultrasonic wave is attenuated while transmitting in the air. As a result, the component of the audible sounds superimposed on the ultrasonic wave at a lower frequency relative to the ultrasonic wave can be reproduced. In general, a sound of a higher frequency transmits along the sound axis with a smaller deflection from the axis. In this case, the radiation angle thus becomes smaller and a sharper directivity can be expected. Since parametric speaker 13 utilizes the ultrasonic wave having a frequency higher than the audible sounds, parametric speaker 13 can radiate a sound wave with a sharp directivity. The audible sounds influenced by nonlinearity of the air and produced during the transmitting of the ultrasonic wave can obtain a sharp directivity. The predetermined distance at which the sound pressure of the audible sound reaches has a peak is referred to as a sound pressure peak distance, which includes a margin of error.

Parametric speaker 13 is mechanically connected to driver 13 including a built-in motor. Parametric speaker 13 is thus disposed to display 11 via driver 15. Parametric speaker 13 and driver 15 constitute parametric speaker unit 17.

Driver 15 is electrically connected to controller 19, and can move parametric speaker 13 along vertical directions 13A and horizontal directions 13B with respect to display 11 about driver 15 in response to a control signal supplied from controller 19. This mechanism changes a direction of the sound wave radiated by parametric speaker 13 within a drivable range of driver 15. In other words, the direction of the sound axis can be changed to any direction within the drivable range of driver 15, so that sound information can be delivered to specific persons. In the following description, the direction of the sound axis is defined as a direction of parametric speaker 13.

The drivable range of driver 15 is determined as follows. A swivel range of horizontal directions 13B is set to 180 degrees, and thus allows the sound axis to be directed to entire horizontal directions 13B in form of display 11. A swivel range of vertical directions 13A of the sound axis is set to 10 degrees downward with respect to display 11 and 30 degrees upward with respect to display 11. This mechanism covers differences of heights of persons passing in front of display 11. The above swivel ranges are just examples and the present invention is not limited to these examples. The range, within which a reproduced sound is desirably delivered, can be determined based on a mounting position, a size, and installation environment of display 11, and the sound pressure peak distance of audible sound radiated from parametric speaker 13.

Controller 19 stores content data 21, and outputs a video signal to display 11 in addition to the controlling of driver 15. Content data 21 includes video information and sound information. Controller 19 outputs a sound signal of content data 21 to parametric speaker (PS) driving circuit 23. Content data 21 can be previously stored in a storage medium built in controller 19, or can be sent from an outside of the device via a communication function and then received by controller 19.

PS driving circuit 23 for the parametric speaker superimposes an audible sound component of the sound signal of content data 21 to the ultrasonic wave, and then, outputs it to parametric speaker 13 which radiates the sound information with a sharp directivity.

Human-body sensor 25 for detecting persons is further disposed to display 11. Human-body sensor 25 may be implemented by a pyroelectric sensor or a camera that outputs an image signal. According to Embodiment 1, a camera is used as human-body sensor 25. The camera is equipped with a wide angle lens to obtain an imaging area greater than the drivable range of driver 15. This structure allows human-body sensor 25 to cover the range where the sound of parametric speaker 13 can reach. Human-body sensor 25 is electrically connected to controller 19, so that the image signal is supplied from human-body sensor 25 to controller 19.

Loudspeaker 27 is further disposed to display 11. Loudspeaker 27 has a wider directivity than parametric speaker 13, and is implemented by an ordinary dynamic loudspeaker according to Embodiment 1. Loudspeaker 27 is disposed on the right-hand side of display 11, as shown in FIG. 1. Loudspeaker 27 is electrically connected to loudspeaker (LS) driving circuit 29 electrically connected to controller 19. The sound signal of content data 21 stored in controller 19 is supplied to LS driving circuit 29 which amplifies the sound signal and supplies the signal to loudspeaker 27.

An operation of sound reproducing device 1001 will be described below.

First, a basic operation of sound reproducing device will be described below. Controller 19 outputs a video signal of content data 21 to display 11, and display 11 displays the video information. The video information is a static image, static images switched over, or a dynamic image. The video information is not limited to any one of these images and can be a combination of these images.

Controller 19 then detects the number of persons in front of display 11 based on an image signal supplied from human-body sensor 25. This can be performed by, e.g. a human recognition function employed in a digital camera.

The phrase, "in front of display 11" is defined as an area within the drivable range of driver 15 and within a range to the sound pressure peak distance (including a margin of error) from parametric speaker 13. The sound pressure peak distance is a predetermined value listed on the specification of parametric speaker 13, and is 2 meters according to Embodiment 1.

The distance to human-body sensor 25 from parametric speaker 13 is predetermined. The distances to the persons from sensor 25 can be detected due to a focusing process to the persons captured by sensor 25. The image signal supplied from human-body sensor 25 allows the distances to the detected persons and angles from the center of sensor 25 to the persons to be detected. Controller 19 calculates the distance between the persons and parametric speaker 13 based on the distance and the angle.

Controller 19 compares the calculated distance with the sound pressure peak distance, and detects the number of the persons in front of display 11. Places hard for persons to hear the audible sound reproduced by parametric speaker 13 are thus determined not to be located in front of display 11, so that persons in those places are not counted.

Next, an operation of sound reproducing device 1001 in the case that controller 19 detects only one person in front of display 11 and this number is equal to a number of parametric speaker 13 will be described. In this case, controller 19 causes driver 15 to change the direction of parametric speaker 13 toward the person, and then outputs the sound information of content data 21 to PS driving circuit 23. The sound signal contains an audible sound component, e.g. voice, music, or effective sound. The audible sound component; however, is not limited to one of them, but it can be a combination thereof.

PS driving circuit 23 superimposes the audible sound component of the sound information on the ultrasonic wave, and outputs it to parametric speaker 13. As a result, speaker 13 reproduces the sound information only to the person, thereby drawing attention from the person to the advertisement. At this moment, it is hard for a large number of persons away from display 11 to hear the sound information, so that the possibility of hearing the sound noisily can be reduced.

Controller 19 then repeats an operation of determining the distance between the person in front of display 11 and parametric speaker 13 based on an output from human-body sensor 25. When controller 19 detects that the person approaches display 11 to a predetermined distance from the parametric speaker, controller 16 causes loudspeaker 27 to reproduce the sound information. This switchover is performed due to the following reason.

As discussed above, the sound pressure of the audible sound reproduced by parametric speaker 13 has characteristics having the sound pressure peak distance. When a person approaches parametric speaker 13 to a distance smaller than the sound pressure peak distance, the sound pressure of the audible sound decreases and prevents the person from hearing the sound information. When controller 19 detects that the person approaches display 11 to a predetermined distance from display 11, controller 19 causes loudspeaker 27 to reproduce the sound information instead of parametric speaker 13. In this case, the sound volume of loudspeaker 27 is set in advance at an audible level in front of display 11, to be more specific, audible in a range within 2 meters from parametric speaker 13. The sound information reproduced from loudspeaker 27 can be hardly heard by persons away from display 11, so that the possibility of hearing the sound noisily can be reduced.

As described above, sound reproducing device 1001 allows the sound information to be delivered continuously to the person who is interested in the advertisement of content data 21, and draws more attention to the advertisement. The predetermined distance discussed above is a distance between parametric speaker 13 and loudspeaker 27 to be switched, and actually it is 1 (one) meter according to this embodiment.

To summarize the foregoing actions, when a person stays at a position defined as "in front of display 11", namely, within 2 meters, which is the sound pressure peak distance of parametric speaker 13, from display 11, controller 19 detects the person, and directs parametric speaker 13 to the person, and then causes parametric speaker 13 to reproduce the sound information. Next, when the person approaches display 11 up to the predetermined distance (1 meter), controller 19 detects this approach, and switches parametric speaker 13 to loudspeaker 27 to cause loudspeaker 27 to reproduce the sound information.

When the person who has approached display 11 leaves display 11, controller 19 performs an operation reverse to the above operations. To be more specific, when the person goes away from display 11 by a distance larger than the predetermined distance, controller 19 detects it, and switches loudspeaker 27 to parametric speaker 13 to cause parametric speaker 13 to reproduce the sound information. At this moment, controller 19 directs parametric speaker 13 toward the person. These operations allow the sound information to be kept delivering to the person as far as the person stays within a range of the sound pressure peak distance even the person leaves display 11, so that the advertisement can keep drawing attention from the person based on the sound information.

Next, an operation of sound reproducing device 1001 in another case that controller 19 detects multiple persons, and the number of the persons is greater than the number of parametric speakers 13 will be described. In this case, controller 19 does not cause parametric speaker 13 to reproduce the sound, but causes loudspeaker 27 to reproduce the sound. At this moment, as discussed previously, the sound volume is set in advance to an audible level in front of display 11, so that the sound reproduced by loudspeaker 27 can be delivered to all the persons around display 11; however, persons away from display 11 can hardly hear the sound. As a result, the possibility of hearing the sound noisily can be reduced.

The number of a person may be one and parametric speaker 13 reproduces the sound information to the person. During this operation, controller 19 detects another person coming in front of display 11 based on an output from human-body sensor 25. In this case, if controller 19 determines that the number of persons is greater than the number of parametric speaker 13, controller 19 switches parametric speaker 13 to loudspeaker 27 to cause loudspeaker 27 to reproduce the sound information. The first person who has caught the sound information from parametric speaker 13 can still catch the sound information from loudspeaker 27. Another person coming later can catch the sound information from loudspeaker 27 from the beginning of the sound information. As a result, the sound information can be delivered appropriately to the situation to both the person coming earlier and the person coming later, and the advertisement can thus draw attentions from both the persons.

Controller 19 switches parametric speaker 13 to loudspeaker 27 to continuously supplying the sound information to the persons, the sound information reproduced by parametric speaker 13 is the same as that reproduced by loudspeaker 27. However, the sound information is not necessarily limited to the same one, and controller 19 may cause speaker 13 and loudspeaker 27 to reproduce different sound information from each other. If the person is interested in the advertisement due to the sound information reproduced by parametric speaker 13 and approaches display 11, loudspeaker 27 supplies different sound information to the person. As a result, the advertisement can draw deeper attention from the person. In this case, parametric speaker 13 supplies relatively short sound-information, such as a product name or a catch phrase, while loudspeaker 27 supplies detail information of the advertisement. This combination will increase the attention drawn to the advertisement.

Next, an operation in the case that all the persons in front of display 11 leave that place will be described below. If controller 19 determines that human-body sensor 25 no longer detects any person, controller 19 causes both of parametric speaker 13 and loudspeaker 27 to stop reproducing the sound information. Controller 19 also stops driver 15 to work during the reproduction of the sound information by parametric speaker 13. This operation stops the reproduction of the sound information when nobody is found, so that power saving can be achieved. In this case, a display of video information can be turned off on display 11, thereby saving more power.

An output from human-body sensor 25 then notifies controller 19 of a person approaching in front of display 11 up to the sound pressure peak distance, controller 19 then starts controlling driver 15 to direct parametric speaker 13 toward the person, and cause speaker 13 to reproduce the sound information. At this moment, if the video information is turned off on display 11, controller 19 causes display 11 to display the video information again. The operations onward are the same as discussed previously. Controller 19 controls parametric speaker 13 such that the sound volume of the sound information increases step by step to the predetermined level. This action allows reducing the possibility that the person is surprised at hearing abruptly the sound information. The predetermined level has been determined in advance at a sound volume that can be well heard by the person at the sound pressure peak distance, and is stored in a memory of controller 19.

The control of reproducing the sound volume to increase step by step is not a mandatory control method. For instance, this control is not necessarily carried out when display 11 is placed in an environment of large ambient sound and the person is thus not surprised at the sound information reproduced at the predetermined sound volume from the beginning.

The above structure and operation allow controller 19 to switch a control to another control in response to the number of persons in front of display 11, that is, controller 19 controls driver 15 to change the direction of parametric speaker 13 before reproducing the sound information, on the other hand, controller 19 controls loudspeaker 27 to reproduce the sound information. As a result, sound reproducing device 1001 can reduce the possibility for a large number of persons to hear the sound information noisily, and yet, it can draw attentions to the advertisement from the persons in front of display 11.

In sound reproducing device 1001 in accordance with Embodiment 1, controller 19 switches parametric speaker 13 to loudspeaker 27 to cause loudspeaker 27 to reproduce the sound information in response to the number of persons in front of display 11 or the distances between the persons and display 11. Here is another control: controller 19 causes loudspeaker 27 to always reproduce the sound information at a sound volume audible within the sound pressure peak distance, and controller 19 switches loudspeaker 27 to parametric speaker 13 to cause parametric speaker to reproduce the sound information when human-body sensor 25 detects a person. The reason for employing another control will be described below:

Parametric speaker 13 has a sound pressure that increases gradually along the sound axis of speaker 13 up to the sound pressure peak distance, while the sound pressure decreases at a further distance from the sound pressure peak. On the other hand, loudspeaker 27 (dynamic loudspeaker) has a sound pressure that simply decreases at a greater distance along the sound axis. The reproduction of the sound information by loudspeaker 27 at a sound level audible within the sound pressure peak distance provides a lower sound pressure at the sound pressure peak distance. This level reduces the possibility for the persons to hear the sound information noisily; however, in the case that display 11 is installed in the environment of large ambient sound, there is a possibility that the sound information cannot be fully delivered to the persons. To overcome this problem, controller 19 uses parametric speaker 13 in addition to loudspeaker 27 for reproducing the sound information when a person is detected, so that the sound information at a greater sound level can be delivered to the person staying at the sound pressure peak distance. This operation allows sound reproducing device 1001 to reduce the feeling of noisy sound and yet to draw attention to the advertisement.

Parametric speaker 13 may be switched completely to loudspeaker 27 for reproducing the sound information. While parametric speaker 13 reproduces the sound information, loudspeaker 27 may reproduce sound information to a person when the person is detected, while loudspeaker 27 may always reproduce the sound information.

The structures and the operations described below of sound reproducing device 1001 in accordance with Embodiment can be selected or combined at user's requirement.

(1) Driver 15 can change the direction of parametric speaker 13 in vertical directions 13A and horizontal directions 13B.

This structure allows a drivable range in vertical directions 13A to be smaller than that in horizontal directions 13B, so that parametric speaker 13 can be manually adjusted in vertical direction 13A before it is fixed depending on the installation place of display 11, or speaker 13 can be fixed at a predetermined angle relative to vertical directions 13A. Driver 15 has a simple structure due to one of these structures. The structure of driver 15 is thus not limited to the structure drivable both in vertical directions 13A and horizontal directions 13B by controller 19.

(2) Controller 19 stops the reproduction of the sound information when human-body sensor 25 detects no person, and stops the operation of driver 15.

Display 11 may be installed on a wall along a street on which a large number of people passes. In this case, even if human-body sensor 25 breaks off a detection of a person, human-body sensor 25 detects another person right after the break-off, for instance, during the time zone when a lot of people pass by the wall. Controller 19 can keep the loudspeaker reproducing the sound information even if no person is detected. This control method allows controller 19 to carry out advantageously a simple control during this time zone. Controller 19 is thus not limited to the operation that the reproduction of the sound information is stopped when no person is detected.

(3) When an output from human-body sensor 25 notifies controller 19 of a person approaching display 11 up to a predetermined distance, controller 19 causes loudspeaker 27 to reproduce the sound information.

When the content on display 11 needs not reproducing sound information, it is not necessarily to switch parametric speaker 13 to loudspeaker 27 for reproducing the sound information even if the person approaches display 11 up to the predetermined distance. In this case, the reproduction of the sound information by parametric speaker 13 aims to draw attention from the person to display 11. This mechanism allows controller 19 to carry out advantageously a simple control. In the case that a large number of persons are in front of display 11, the following cases can be conceivable: Parametric speaker 13 is switched to loudspeaker 27 for reproduction of the sound information, or the sound information is always reproduced by loudspeaker 27 at a sound level audible to the persons in front of display 11. These cases prove that loudspeaker 27 is still necessary.

(4) When an output of human-body sensor 25 informs controller 29 of the number of persons being greater than the number of parametric speakers 13, controller 19 switches speaker 13 to loudspeaker 27 for reproduction of the sound information.

This control is not needed when loudspeaker 27 always reproduces the sound information as discussed above, so that controller 19 can carry out advantageously a simpler control; however, since loudspeaker 27 is kept reproducing the sound information, the control method described in item (3) or (4) is recommended from the perspective of power saving. It can be thus concluded that an appropriate control method can be selected depending on the environment of ambient sound or the requirement of power saving.

According to Embodiment 1, a flat panel display equipped with light source 11L is used as display 11; however, the present invention is not limited to this example. For instance, a product per se displayed in a show window, a poster, or a signboard can be used as display 11. In such a case, a video signal of content data 21 is not needed, and yet, attention can be drawn from persons to the advertisement, i.e. the product per se, poster, signboard, photograph, or picture. In the case of employing the flat panel display, a transparent or reflective electronic paper can be used as display 11. In this case, since display 11 has no light source, sufficient visual attention cannot be drawn; however, display 11 in this case can be bent and light-weighted so that it can be installed without so many restrictions. It can be thus concluded that appropriate display 11 can be selected depending on the installation environment.

According to Embodiment 1, driver 15 and human-body sensor 25 are mounted to the upper part of display 11; however, the present invention is not limited to this structure. For instance, they can be mounted to the left, right, or lower part of display 11, or they can be individually mounted to different sections. As far as they are in the vicinity of display 11, parametric speaker unit 17 and human-body sensor 25 can be mounted at places away from display 11. These structures reduce the possibility of hearing noisy sound, and draw attention to the advertisement similarly to the case that they are mounted to the upper part of display 11. However, if they are placed excessively away from display 11, the sound direction from parametric speaker 13 is deviated from the position of display 11, so that the effect of drawing attention to the advertisement is reduced. Therefore, in a case where parametric speaker unit 17 and human-body sensor 25 are placed away from display 11, it is preferable to place them as near as possible to display 11.

Exemplary Embodiment 2

The structure of sound reproducing device 1001 in accordance with Exemplary Embodiment 2 is the same as that shown in FIG. 1, so that the detailed descriptions thereof are omitted here. Sound reproducing device 1001 in accordance with Embodiment 2 is capable of carrying out the basic operation discussed above, i.e. human-body sensor 25 outputs the number of persons in front of display 11, and controller 19 causes driver 15 to change the direction of parametric speaker 13 in response to the output before speaker 13 reproduces the sound information, and controller 19 switches speaker 13 to loudspeaker 27 for reproducing the sound information. In addition to these basic operations, this sound reproducing device 1001 can carry out the following operations (5) to (9):

(5) If the number of persons output from human-body sensor 25 is equal to or smaller than the number of parametric speakers 13, controller 19 controls driver 15 to follow the persons to reproduce the sound information to the persons.

(6) If the number of persons output from human-body sensor 25 is greater than the number of parametric speakers 13, controller 19 controls driver 15 to follow the persons and to cause parametric speaker 13 to reproduce predetermined sound information to a certain person out of the persons. After that, controller 19 controls driver 15 to cause parametric speaker 13 to reproduce the predetermined sound information to another person out of the persons. Controller 19 repeats the foregoing series of actions.

(7) During the operation (6), controller 19 detects firstly a person closest to display 11 among the persons based on the output from human-body sensor 25.

(8) When the number of persons output from human-body sensor 25 is greater than the number of parametric speaker 13, controller 19 changes over the control to cause both of speaker 13 and loudspeaker 27 to reproduce the sound information simultaneously.

(9) During the operation (8), controller 19 increases the sound volume of loudspeaker 27, and decreases the sound volume of speaker 13.

The above operations (5) to (9) will be described in detail below. First, the case that operation (5) is added to the basic operation will be described. Sound reproducing device 1001 in accordance with Embodiment 2 includes one parametric speaker 13, so that when human-body sensor 25 outputs the number of persons and the number which is equal to or smaller than the number of speaker 13, the number of the persons is one. In this case, controller 19 image-processes the output from human-body sensor 25 to determine the direction of the person, and causes driver 15 to direct parametric speaker 13 along the direction. When the person moves, controller 19 detects the movement based on the output from human-body sensor 25, and controls driver 15 to follow the movement of the person. At this moment, controller 19 causes parametric speaker 13 to reproduce the sound information. As a result, even when the person moves in front of display 11, parametric speaker 13 keeps delivering the sound information to the person, so that more attention can be drawn from the person to the advertisement. On top of that, controller 19 follows the person with parametric speaker 13 reproducing the sound information, so that only the person can hear the sound information. The above operation reduces the possibility for a large number of persons to hear noisy sound.

Next, the case that operation (6) is added to the basic operation will be described. As discussed above, the number of parametric speaker 13 is one, when human-body sensor 25 outputs the number of persons greater than this number which is two or more than two. In this case, controller 19 image-processes the output from sensor 25, thereby selecting a certain person, and then controller 19 finds the direction toward the certain person. Controller 19 then causes driver 15 to direct parametric speaker 13 toward the certain person. At this moment, controller 19 causes speaker 13 to reproduce predetermined sound information. The predetermined sound information is short data, e.g. a product name or a catch phrase displayed on the advertisement, and the short data is previously stored as content data 21.

When controller 19 finishes the reproduction of the predetermined sound information, controller 19 selects another person based on the result of the image-processing of the output from human-body sensor 25. Controller 19 controls driver 15 to follow another person, and causes parametric speaker 13 to reproduce the predetermined sound information.

Controller 19 repeats the above operations, and resultantly allows the selected persons sequentially to hear the predetermined sound information. The predetermined sound information lasts for a short time since it is heard by the selected persons one after another. The predetermined sound information is thus short information, such as a product name or a catch phrase.

This operation allows parametric speaker 13 to deliver the sound information to persons as many as possible in addition to the advantage obtained by operation (5), so that much more attention can be drawn to the advertisement.

In this operation, namely, during the image-processing of the output from human-body sensor 25, controller 19 also detects firstly the person closest to display 11 among the persons. This operation allows parametric speaker 13 to deliver the sound information firstly to the person who is located at a place to see the advertisement on display 11 earliest, so that more attention can be drawn to the advertisement.

The sound pressure characteristics of parametric speaker 13 have the sound pressure peak distance. Parametric speaker 13 thus delivers the sound information insufficiently to the person approaching close to parametric speaker 13, e.g. up to a distance shorter than the sound pressure peak distance. However, loudspeaker 27 can deliver the sound information to this person. Considering this case, the person detected by controller 19 firstly among the persons closest to display 11 is defined as a person who is located closest to display 11 and yet located in the vicinity of the sound pressure peak distance.

Controller 19 can skip operation (7) but carry out only operation (6). In the case of installing display 11 at a place where a large number of persons pass is expected, it is difficult to give priority to a person one out of the persons. To this case, only operation (6) can be performed. Controller 19 thus can work simpler because no priority is determined.

Next, the case that operation (8) is added to the basic operation will be described. When human-body sensor 25 outputs the number of persons greater than the number of parametric speaker 13, the number of persons is two or more than two. In this case, controller 19 causes both of parametric speaker 13 and loudspeaker 27 to reproduce the sound information simultaneously. As discussed in operations (6) and (7), in addition to the operation of parametric speaker 13 to reproduce the predetermined sound information to a certain person detected, loudspeaker 27 also reproduces the sound information. This operation allows the person interested in the advertisement through hearing the predetermined sound information to keep hearing the sound information from loudspeaker 27. As a result, more attention can be drawn to the advertisement.

The sound information reproduced by loudspeaker 27 can be the same as or different from that reproduced by parametric speaker 13. In the case that the sound information is the same, persons can hear the predetermined sound information repeatedly from loudspeaker 27 while speaker 13 deliver the predetermined sound information to another person, thereby more attention can be drawn to the advertisement. In the case that they are different, loudspeaker 27 reproduces, e.g. sound information detailing the advertisement, thereby deeper attention can be drawn to the advertisement.

During this operation, controller 19 also carries out operation (9) simultaneously, namely, controller 19 increases the sound volume of loudspeaker 27, and makes the sound volume of parametric speaker 13 smaller than that of loudspeaker 27. When a large number of persons stay in front of display 11, this operation allows parametric speaker 13 to draw attention from a certain person to the advertisement with a small sound volume while causing loudspeaker 27 to deliver the sound information to the large number of persons with a large sound volume. As a result, attention can be drawn to the advertisement more efficiently.

Controller 19 can skip operation (9) and carry out only operation (8). For instance, when a small number of persons stay in front of display 11, they can well hear the sound information from loudspeaker 27 without increasing the sound volume. In this case, controller 19 can skip operation (9) and only carry out operation (8). This skip reduces the possibility for a large number of persons away from display 11 to hear noisy sound.

The foregoing structures and operations allow sound reproducing device 1001 to reduce the possibility for the large number of persons to hear the sound information noisily, and to draw much more attention from the persons in front of display 11 to the advertisement.

Sound reproducing device 1001 in accordance with Embodiment 2 can carry out the operations (5) to (9) simultaneously, or selects or combine operations (5), (6), and (8) as discussed above depending on the installation site of device 1001 or the content of the advertisement. As a result, useless actions can be eliminated, and yet the feeling of noisy sound can be reduced, and the attention can be more drawn to the advertisement.

Exemplary Embodiment 3

Figure 2:
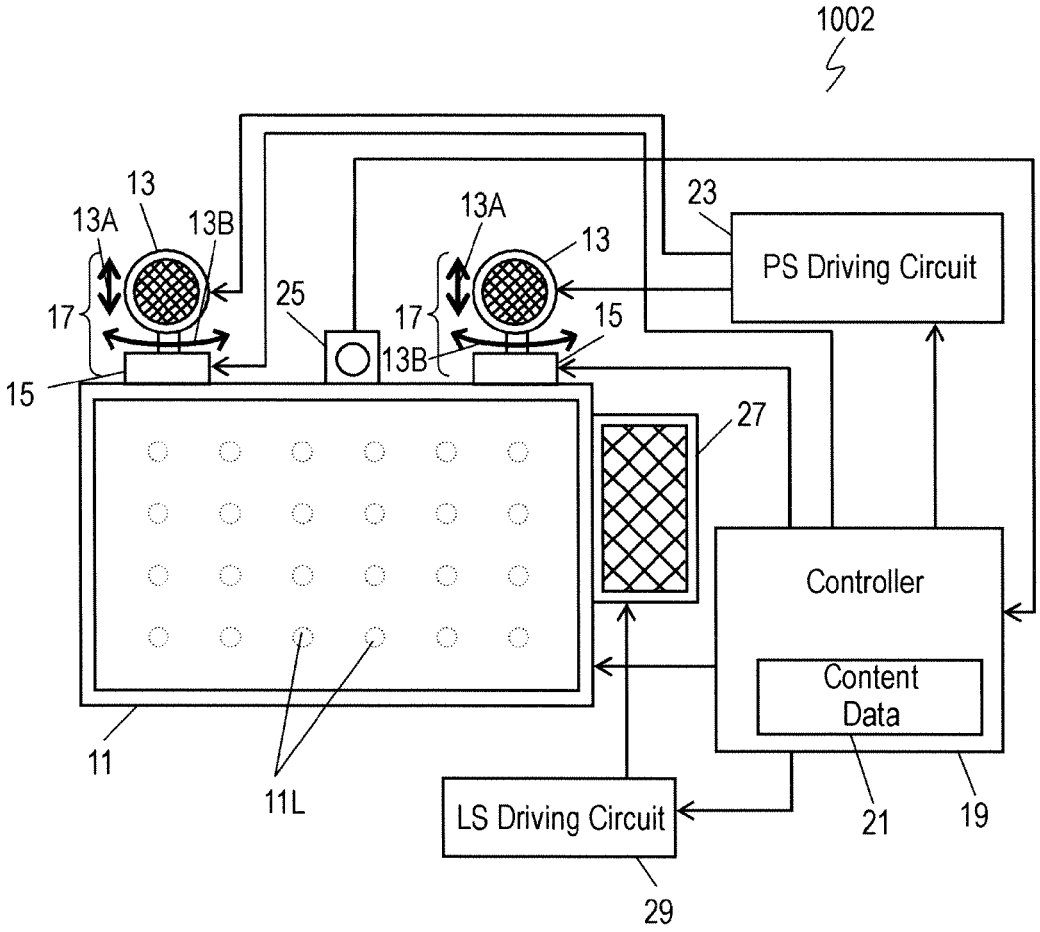
FIG. 2 is a schematic view of a sound reproducing device in accordance with Exemplary Embodiment 3 of the invention.

FIG. 2 is a schematic view of sound reproducing device 1002 in accordance with Exemplary Embodiment 3 of the present invention. In FIG. 2, components identical to those of sound reproducing device 1001 shown in FIG. 1 are denoted by the same reference numerals.

As shown in FIG. 2, sound reproducing device 1002 in accordance with Embodiment 3 includes plural parametric speaker units 17 mounted to display 11. Parametric speakers 13 and drivers 15 constitute parametric speaker units 17. Each of parametric speaker units 17 is composed of respective one of parametric speakers 27 and respective one of drivers 15. According to Embodiment 3, sound reproducing device 1002 includes two parametric speaker units 17.

Parametric speakers 13 are electrically connected with single parametric speaker (PS) driving circuit 23, so that parametric speakers 13 reproduce the same sound information.

Next, an operation of sound reproducing device 1002 will be described below.

In the basic operation, due to two drivers 15 in accordance with Embodiment 3, in the case that human-body sensor 25 outputs two as the number of persons in front of display 11, drivers 15 change the directions of parametric speakers 13 for reproducing the sound information. As a result, speakers 13 can deliver the sound information to the two persons simultaneously, respectively. Sound reproducing device 1002 can increase the attention drawn to the advertisement more than sound reproducing device 1001 in accordance with Embodiments 1 and 2

In the case that two persons are detected by human-body sensor 25, it is determined which one of two speakers 13 is directed to which one of two persons based on the distances between speakers 13 and the persons. These distances are determined by controller 19. To be more specific, since parametric speakers 13 have a sound pressure peak distance, controller 19 directs parametric speakers 13 toward a person who is closer to the sound pressure peak distance than the other person. As described in Embodiment 1, the distances between respective speakers 13 and the respective persons are determined by controller 19 based on the output from human-body sensor 25. The above operation allows one parametric speaker 13 having a higher sound pressure than the other parametric speaker 13 to firstly deliver the sound information to the persons. As a result, the persons can hear more clearly the sound information.

Next, the case that the number of persons detected by human-body sensor 25 is smaller than the number of parametric speakers 13 will be described below. One person is detected in this case. In this case, controller 19 directs, toward the one person, one parametric speaker 13 closer to the sound pressure peak distance than the other speaker 13, and causes only this closer speaker 13 to reproduce the sound information. This operation allows the person to hear clearer sound information. Controller 19 stops the other parametric speaker 13 and drives only the parametric speaker 13 reproducing the sound information, so that power saving can be achieved.

The operation in the case of a smaller number of persons than the number of parametric speakers 13 is not limited to the action of driving only necessary speaker 13. For instance, both of the two parametric speakers 13 can be directed toward one person to cause the parametric speakers to reproduce the sound information simultaneously. In this case, although an electric power for driving both of speakers 13 is needed, much clearer sound information can be delivered to the person in the environment of large ambient sound. Depending on the ambient sound, driving only a necessary parametric speaker 13 or driving both of parametric speakers 13 can be selected.

In the case that two parametric speakers 13 are driven simultaneously to one person, the same sound information is reproduced in accordance with Embodiment 3; however, the present invention is not limited to this case. For instance, two parametric speakers 13 can reproduce different sound information, e.g. stereo sound, thereby stereophonic sound information can be delivered to the person, and therefore, deeper attention can be drawn to the advertisement.

Next, the case that the number of persons detected by human-body sensor 25 is greater than the number of parametric speakers 13 will be described below. To be more specific, the case that the number of persons is three or greater than three will be described. In this case, parametric speakers 13 cannot sufficiently deliver the sound information to all the persons, so that controller 19 causes loudspeaker 27, in addition to parametric speakers 13, to reproduce the sound information similarly to Embodiment 1. As a result, attention from all the persons can be drawn to the advertisement.

According to Embodiment 3, in the case that the number of persons is greater than the number of parametric speakers 13, the operation is not limited to the operation of switching parametric speaker 13 to loudspeaker 27 for reproduction of the sound information. This operation is described in embodiments 1 and 2. In other words, controller 19 causes loudspeaker 27 to always reproduce the sound information. When the number of persons becomes greater than the number of parametric speakers 13, controller 19 can stop parametric speaker 13 reproducing the sound information. When the number of persons becomes greater than the number of parametric speakers 13, controller 19 causes both of two parametric speakers 13 and loudspeaker 27 to reproduce the sound information simultaneously. In either case, the sound information can be delivered to all the persons, so that more attention can be drawn to the advertisement.

This above operation allows sound reproducing device 1002 to reduce the possibility for a large number of persons to hear the sound information noisily, and to draw much more attention from the persons in front of display 11 to the advertisement.

Sound reproducing device 1002 in accordance with Embodiment 3 can add or combine operations (1) to (4) described in Embodiment 1 in addition to the basic operation. This combination provides an advantage similar to Embodiment 1.

Sound reproducing device 1002 in accordance with Embodiment 3 can also add or combine operations (5) to (8) described in Embodiment 2 in addition to the basic operation. This combination provides an advantage similar to Embodiment 2.

Controller 19 according to Embodiment 2 controls driver 15 such that parametric speaker 13 follows the direction of the person. According to Embodiment 3, the device includes two parametric speakers 13, and controller 19 controls them as follows. First, the case that the number of persons is smaller than the number of parametric speakers 13, namely, the case that the number of persons is one or two will be described. In the case of two persons, since the same number of parametric speakers 13 is available, controller 19 controls driver 15 such that parametric speakers 13 are directed to the respective persons, respectively. As a result, an advantage similar to Embodiment 2 is obtainable.

In the case of one person, controller 19 controls driver 15 such that either one of parametric speakers 13 can be directed toward the person. This operation is the same as Embodiment 2, so that an advantage similar to Embodiment 2 is obtainable. Controller 19 may controls driver 15 such that both of parametric speakers 13 can be directed toward the one person. In this case, even the person moves in the environment of loud ambient sound, the sound information can be delivered in clearer sound to the person.

Next, the case that the number of persons is greater than the number of parametric speakers 13, namely, the case of three or more persons, will be described below.

In this case, controller 19 selects two persons from the three or more persons detected by human-body sensor 25, and controls driver 15 to direct respective parametric speakers 13 toward the respective selected persons. When the reproduction ends, controller 19 selects other two persons again. Controller 19 repeats this operation. The greater the number of parametric speakers 27, the greater the number of persons having the sound information delivered as compared with sound reproducing device 1001 in accordance with Embodiment 2.

In this case, operation (7) described in Embodiment 2, i.e. based on the output from human-body sensor 25, controller 19 can detect firstly a person who is closest to display 11 and in the vicinity of the sound pressure peak distance, among the persons. In this case, since two parametric speakers 13 are available, controller 19 selects two persons in the order of closer to display 11 as the persons closest to display 11. After the reproduction of the sound information ends, controller 19 again detects persons closest to display 11 at this moment based on an output from human-body sensor 25, and then excludes the persons to whom the sound information has been delivered, and selects two persons in the order of closer to display 11. Controller 19 repeats this operation, thereby increasing the attention drawn from more persons to the advertisement.

When the number of persons output from human-body sensor 25 is changed, sound reproducing device 1002 in accordance with Embodiment 3 immediately switch to the respective operations in response to the number of persons. This operation efficiently increases the attention from the persons to the advertisement in response to the change in the number of persons.

According to Embodiment 3, two parametric speakers 13 are used; however, a greater number of speakers 13 can be used. In this case, the operations discussed above are applicable, so that the sound information can be delivered to much more persons simultaneously and the attention can be drawn more efficiently to the advertisement.

Exemplary Embodiment 4

Figure 3:
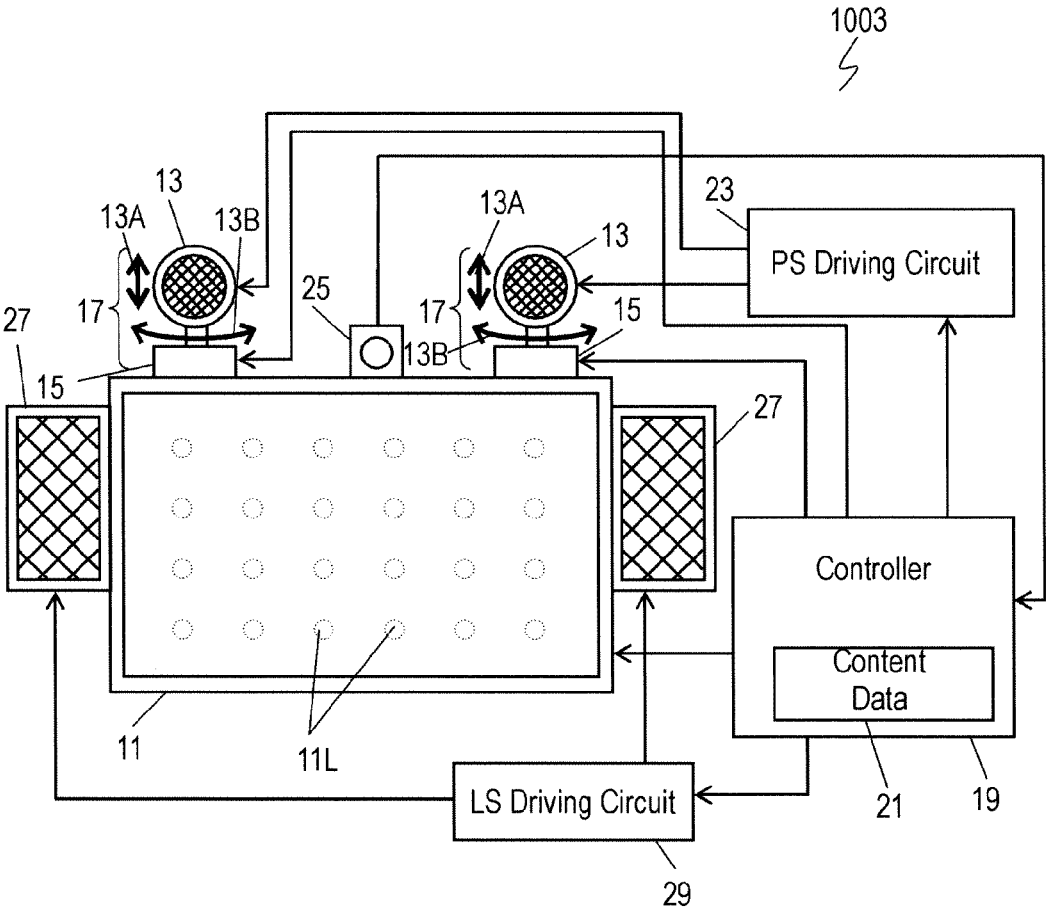
FIG. 3 is a schematic view of a sound reproducing device in accordance with Exemplary Embodiment 4 of the invention.

FIG. 3 is a schematic view of sound reproducing device 1003 in accordance with Exemplary Embodiment 4. In FIG. 3, components identical to those of sound reproducing device 1002 in accordance with Embodiment 3 shown in FIG. 2 are denoted by the same reference numerals. Sound reproducing device 1003 in accordance with Embodiment 4 includes loudspeaker 27 disposed at the left side of display 11 besides loudspeaker 27 at the right side, as shown in FIG. 3. Two loudspeakers 27 are thus mounted to display 11 in accordance with Embodiment 4. Loudspeaker 27 at the left side is electrically connected to loudspeaker (LS) driving circuit 29.

An operation of sound reproducing device 1003 will be described below. In sound reproducing device 1003, two loudspeakers 27 reproduce the sound information. When a large number of persons stay around display 11, sound reproducing device 1003 can deliver the sound information sufficiently to them.

Two loudspeakers 27 can reproduce the same sound information or they can reproduce different sound information. In the case of reproducing the same sound information, the large number of persons can hear the same sound information, so that the most appealing point of the advertisement can be delivered efficiently. In the case of reproducing different sound information, e.g. use of stereo sound allows the large number of persons to hear stereophonic sound effect, so that deeper attentions can be drawn to the advertisement.

The operations other than above are the same as those of sound reproducing device 1002 in accordance with Embodiment 3.

The above operation allows sound reproducing device 1003 to reduce the possibility for the large number of persons to hear the sound information noisily, and to draw more attentions from the persons around display 11 to the advertisement. These are the same advantages as those of sound reproducing device 1002 in accordance with Embodiment 3.

Sound reproducing device 1003 in accordance with Embodiment 4 includes two loudspeakers 27 mounted to display 11; however, three or more loudspeakers 27 can be mounted to display 11. In this case, even if display 11 is large enough across the entire wall, a large number of loudspeakers 27 are available, and each one of loudspeakers 27 reproduces the sound information at a sound level lower than noisy sound. As a result, sound reproducing device 1003 reduces the noisy feeling, and yet, delivers the sound information to all the persons around display 11.

According to Embodiment 4, sound reproducing device 1003 includes additional loudspeaker 27 in addition to components of sound reproducing devices 1002 shown in FIG. 2 and in accordance with Embodiment 3. However, the device according to Embodiment 4 is not limited to this structure. Loudspeaker 27 can be added to sound reproducing device 1001 including single parametric speaker 13 in accordance with Embodiments 1 and 2. In this case, an advantage similar to that obtained in the fourth embodiment can be expected.

According to Embodiment 4, operations (1) to (4) described in Embodiment 1 can be added or combined. This combination provides an advantage similar to Embodiment 1.

According to Embodiment 1, any one of operations (5) to (8) described in Embodiment 2 can be added or combined. In this case, this combination provides an advantage similar to Embodiment 2.

Sound reproducing devices 1001 to 1003 in accordance with embodiments 1 to 4 are disposed to advertisement display 11. Sound reproducing devices 1001 to 1003 can be applied to, e.g. a structure formed of a consumer television receiver equipped with parametric speaker 13. In this case, parametric speaker 13 is used for reproducing the sound of a television program, and electrical driver 15 is also disposed in order to adjust the hearing direction of parametric speaker 13. The operations described in Embodiments 1 to 4, e.g. driver 15 changes the direction of parametric speaker 13 in response to an output from human-body sensor 25, are stored as a demonstration mode in software of controller 19. A brand name of the television receiver and the operation manual of the receiver by voice are stored as the sound information of the demonstration mode. Next, when the consumer television receiver is displayed on shop front, the demonstration mode is carried out. Then, the television receiver delivers, in response to an output from human-body sensor 25, the sound information from parametric speaker 13 to visitors in the shop. The television receiver thus advertises for itself, and it can draw attention from the visitors.

Exemplary Embodiment 5

Figure 4:
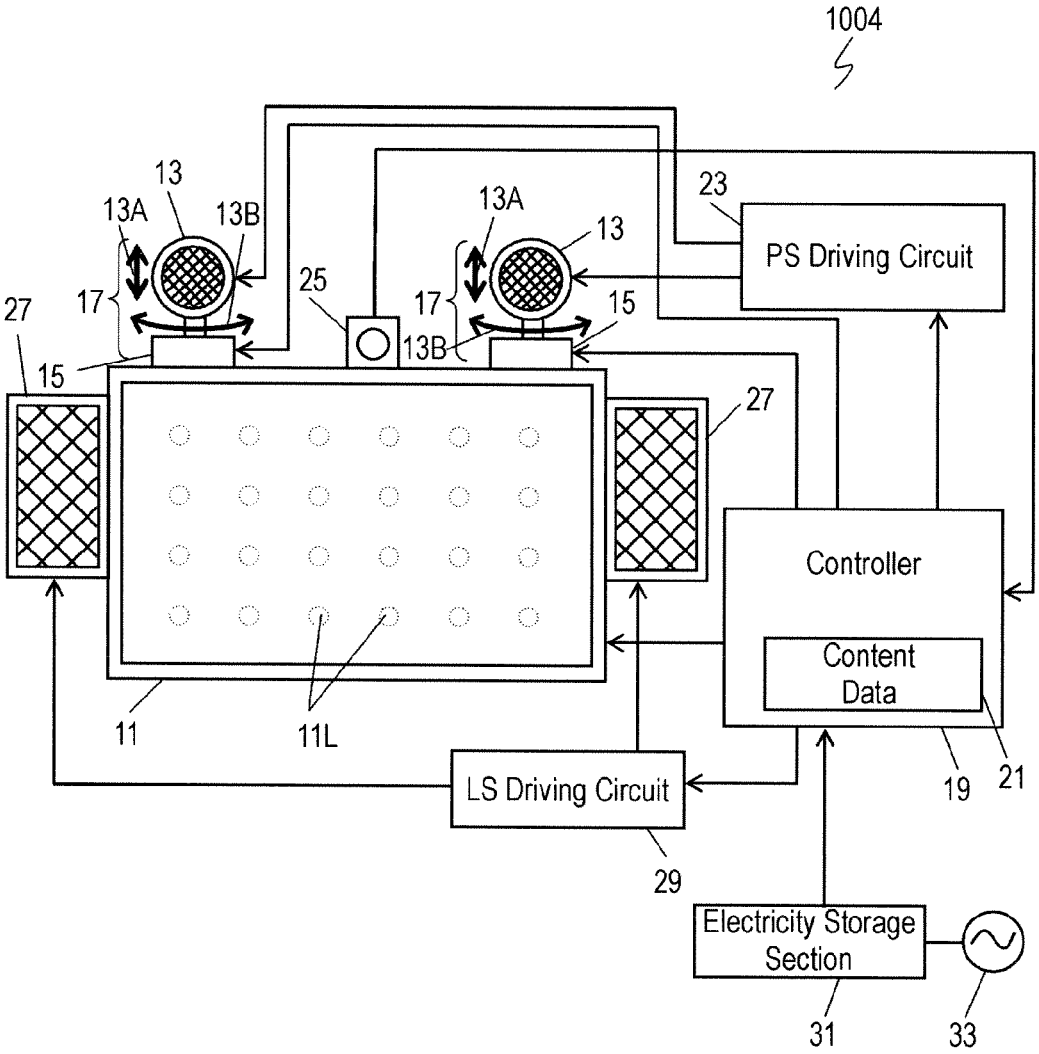
FIG. 4 is a schematic view of a sound reproducing device in accordance with Exemplary Embodiment 5 of the invention.
Figure 5:
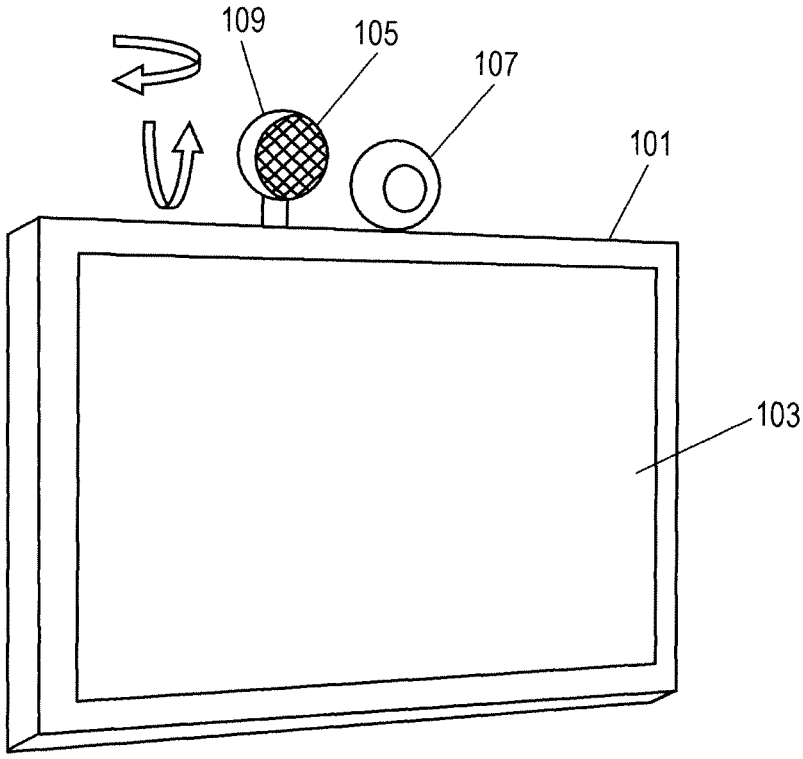
FIG. 5 is a perspective view of a conventional sound reproducing device.

FIG. 4 is a schematic view of sound reproducing device 1004 in accordance with Exemplary Embodiment 5. In FIG. 4, components identical to those of sound reproducing device 1003 shown in FIG. 3 in accordance with Embodiment 4 are denoted by the same reference numerals. As shown in FIG. 4, electricity storage section 31 is connected to controller 19 of sound reproducing device 1004. Electricity storage section 31 is implemented by a secondary battery that stores electric power, and a charge and discharge circuit for the secondary battery. Electricity storage section 31 is electrically connected to utility power supply 33.

Electricity storage section 31 charges electric power of a utility power supply to the secondary battery and supplies the power to controller 19 during the normal operation of utility power supply 33, namely, during no power outage. The charge and discharge circuit of electricity storage section 31 detects whether or not utility power supply 33 works normally. The detection result is supplied to controller 19 electrically connected to, as shown in FIG. 4, display 11, parametric speaker (PS) driving circuit 23, loudspeaker (LS) driving circuit 29, driver 15, and human-body sensor 25. Parametric speaker 13 is electrically connected to PS driving circuit 23. Loudspeaker 27 is electrically connected to LS driving circuit 29. The electric power supplied to controller 19 from utility power supply 33 is also supplied to the above structural elements.

Next, an operation of sound reproducing device 1004 in accordance with Embodiment 5 will be described below. First, when utility power supply 33 works normally, i.e. during no power outage, device 1004 works similarly to the device according to Embodiment 4, thereby providing advantages similar to those of Embodiment 4, namely, reducing the possibility for the large number of persons to hear the sound information noisily, and drawing attention from the persons around display 11 to the advertisement.

In the case that utility power supply 33 causes a power outage due to disaster or accident, or rolling blackouts are implemented will be described below. The charge and discharge circuit detects the power outage, and then immediately disconnects electricity storage section 31 from utility power supply 33. This operation prevents the electric power stored in the secondary battery of electricity storage section 31 from flowing reversely to utility power supply 33. At this moment, the charge and discharge circuit supplies the electric power of the secondary battery to controller 19. Electricity storage section 31 informs controller 19 of the occurrence of power outage.

When power outage occurs, electric power supplied from electricity storage section 31 allows controller 19 to display video information for power outage on display 11. This video information is stored in advance in content data 21. This video information may be a text data that informs the persons in front of display 11 of an occurrence of power outage or rolling blackouts. If display 11 is installed in a building or on an underpass, the video information may be image information that informs the persons in front of display 11 of the closest exit. The video information for power outage is not limited to data stored in advance in content data 21, for instance, the information can be transferred between controller 19 and the outside through cable or wirelessly. In this case, if an apparatus sending the information to controller 19 encounters the power outage, and yet, still works with a backup power supply, various information about the power outage can be displayed as the video information for power outage. In this case, if the apparatus stops working, the video information for power outage stored in advance in content data 21 can be displayed.

Controller 19 controls parametric speaker 13 and loudspeaker 27 to reproduce the sound information for power outage stored in advance in content data 21. The sound information for power outage in this context may be sound information that informs people of an occurrence of power outage or rolling blackouts. In the case that the sound reproducing device is installed in a building or on an underpass, the sound information may be audio information that informs people of the closest exit. The sound information for power outage is not limited to data stored in advance in content data 21. For instance, in the case that controller 19 and an apparatus sending and receiving information are still work during the power outage, various information about the power outage can be reproduced as the sound information for power outage. In this case, if the apparatus stops working, the sound information for power outage stored in advance in content data 21 can be reproduced.

In sound reproducing device 1004 in accordance with Embodiment 5, controller 19 causes both of parametric speaker 13 and loudspeaker 27 to reproduce the sound information for power outage since the sound information is to be delivered to people as many as possible in order to secure safety. In the case of a power outage caused by disaster or accident, controller 19 causes both of parametric speaker 13 and loudspeaker 27 to reproduce the same sound information for power outage at the maximum sound level, so that this sound information can be delivered to a large number of people away from the sound reproducing device, thus securing safety. In the case of rolling blackouts, the date and the time thereof are known in advance, so that controller 19 can distinguish a power outage caused by disaster or accident from the rolling blackouts.

As discussed above, controller 19 continues displaying and reproducing the video information and the sound information for power outage. In this case, although human-body sensor 25 stops outputting the data of detecting persons, controller 19 still continues displaying and reproducing the video information and the sound information for power outage in order to secure the safety of a large number of persons away from the sound reproducing device.

At this moment, controller 19 monitors the electric power stored in the secondary battery of electricity storage section 31 based on a signal from electricity storage section 31. When the electric power decreases to a level equal to or lower than a predetermined value, controller 19 stops supplying the power to structural components of lower priority for the sound reproducing device to continue operating as long as possible. This operation will be described in detail below. The predetermined value of electric power is determined appropriately depending on the capacity of the secondary battery, installation environment of the sound reproducing device. The predetermined value is stored in a memory of controller 19. According to Embodiment 5, the predetermined value is a half of the power stored in electricity storage section 31.

When the electric power of electricity storage section 31 decreases by half, controller 19 firstly finds a light intensity obtained by human-body sensor 25. As described in Embodiment 1, human-body sensor 25 is implemented by a camera. The light intensity is obtainable from the picture captured by the camera. According to Embodiment 5, since the detection of a light intensity is needed, the camera is employed as human-body sensor 25; however, in the case that a pyroelectric sensor is employed as human-body sensor 25, it cannot detect a light intensity. In this case, an illumination sensor, e.g. phototransistor, can be employed besides the pyroelectric sensor, and they are integrated into human-body sensor 25.

Next, controller 19 determines whether or not the light intensity obtained is equal to or lower than a predetermined light intensity. The predetermined light intensity in this context is a light level at which a person feels dark and needs some lighting. This level is previously stored in the memory of controller 19.

If human-body sensor 25 detects that the light intensity is equal to or lower than the predetermined light intensity, controller 19 stops reproducing the sound information for power outage, and continues only displaying the video information for power outage. Since this operation stops parametric speaker 13 and loudspeaker 27 reproducing the sound information for power outage, power saved by this operation can be used for display 11. As a result, display 11 can continue displaying the video information even in dark, so that display 11 works as lighting and thus allows people to feel safe. In the case that display 11 is installed in a building or on an underpass, useful information, e.g. guiding persons to the closest exit, can be supplied until electricity storage section 31 exhausts the stored power, thereby securing the safety of the persons. When the light intensity is equal to or lower than the predetermined level, a priority of supplying electric power is predetermined to the structural elements for displaying the video information for power outage, rather than to the structural elements for reproducing the sound information for power outage. Meanwhile the structural elements for the display include display 11 according to Embodiment 5, and those for the sound reproduction include parametric speaker unit 17, PS driving circuit 23, loudspeaker 27, and LS driving circuit 29 according to Embodiment 5.

On the other hand, when the light intensity output from human-body sensor 25 is greater than the predetermined level, controller 19 stops displaying the video information for power outage on display 11, and only causes parametric speaker 13 and loudspeaker 27 to reproduce the sound information for power outage. In other words, an operation reverse to the above operation for the lower light intensity is performed. In this case, the persons can look around the circumstances even display 11 stops displaying the video information for power outage, and they feel more safe than in dark. Controller 19 stops displaying the video information for power outage on display 11, and thus can use the power saved by this stop for parametric speaker 13 and loudspeaker 27 to reproduce the sound information for power outage. As a result, sound reproducing device 1004 continues delivering the sound information for power outage to persons away from the sound reproducing device, thereby allowing the persons to feel safe. In the case that display 11 is installed in a building or on an underpass, useful information, such as guiding persons to the closest exit, can be supplied until electricity storage section 31 exhausts the stored power, thereby securing the safety of the persons. When the light intensity is greater than the predetermined level, a priority of supplying electric power is predetermined to the structural elements for reproducing the sound information for power outage, rather than to the structural elements for displaying the video information for power outage.

In the case of continuing the reproduction of the sound information for power outage, when the power of electricity storage section 31 further decreases, the reproduction from parametric speaker 13 is stopped while the reproduction from only loudspeaker 27 can be kept. In this case, since loudspeaker 27 has a wider directivity than parametric speaker 13, the sound information can be delivered to persons as many as possible until electricity storage section 31 exhausts the power stored therein.

Next, the case that utility power supply 33 returns from power outage to normal operation will be described below. When utility power supply 33 returns to the normal operation, utility power supply 33 supplies the power to the charge and discharge circuit of electricity storage section 31. The charge and discharge circuits returns to a normal operation from the power outage, and determines that the power outage is over, and then immediately connects utility power supply 31 to electricity storage section 31, thereby charging the secondary battery of electricity storage section 31 to a full capacity.

Electricity storage section 31 sends the information to controller 19 about the recovery from power outage, and controller then stops displaying the video information for power outage on display 11, and stops reproducing the sound information for power outage. Then, controller 19 returns the operation to a normal operation, i.e. the operation in no power outage, similar to that described in Embodiment 4. However, if the power outage is recovered from disaster or accident, the video information and the sound information for power outage are kept displaying and reproducing in order to reduce the possibility of secondary disaster happening to people.

The structures and operations discussed above reduce the possibility for a large number of persons to hear the sound information noisily and also drawing more attention from the persons around display 11 to the advertisement. This provides advantages similar to those of Embodiment 4. In addition to these advantages, sound reproducing device 1004 increases the safety to the persons when a power outage occurs.

Electricity storage section 31 according to Embodiment 5 can be applicable to sound reproducing devices 1001 and 1002 in accordance with Embodiments 1 to 3, providing hereby advantages similar to those of Embodiment 5.

According to Embodiment 5, a flat panel display, equipped with light source 11L of self-luminous type or a backlight type, is used as display 11. On the other hand, in the case that display 11 per se is a product to be advertised, a poster, or a sign board, or when display 11 is a flat panel of transparence or reflection type with no light source, controller 19 only reproduces the sound information for power outage regardless of light intensity in the case of power outage. The power saved by not displaying the video information for power outage on display 11 can be thus used for the reproduction of the sound information for power outage. This allows the sound information to be reproduced for a longer time, thereby increasing the safety to the persons. However, from the perspective of improving the safety of persons in dark, the flat panel display with light source 11L is preferably used as described in Embodiment 5.

According to Embodiment 5, a camera is used as human-body sensor 25 for detecting a light intensity; however, if human-body sensor 25 cannot detect the light intensity, e.g. if human-body sensor 25 is implemented by a pyroelectric sensor, controller 19 does not perform a selection in a case of power outage. The selection in this context means whether the video information for power outage or the sound information for power outage is used depending on the power volume of electricity storage section 31 and the light intensity. Controller 19 continues using both of the video information and the sound information for power outage as long as the power remains in electricity storage section 31. The possibility of increasing the safety to people can be thus increased; however, an operating time is forced to be shorter, so that it is preferable, as described in Embodiment 5, to use human-body sensor 25 that can detect the light intensity.

According to Embodiment 5, the secondary battery is built in electricity storage section 31; however another electricity storage device, such as an electrochemical capacitor of large capacity or an electric double-layered capacitor, can be used.

Each of sound reproducing devices 1001 to 1004 according to Embodiments 1 to 5 includes parametric speaker unit 17, human-body sensor 25, and loudspeaker 27. These are fixed to display 11. Sound reproducing devices 1001 to 1004 can be detachable from display 11. In this case, if display 11 is replaced with another one, sound reproducing devices 1001 to 1004 can be used as they are. As a result, sound reproducing devices 1001 to 1004 can be fixed to or detachable from display 11 as far as they can work together with display 11.

Sound reproducing devices 1001 to 1004 reduce the possibility for a large number of persons to hear the sound information noisily, and yet, allows drawing attention to the advertisement, so that they are useful for an advertise-oriented sound reproducing device that reproduces an audio signal to the large number of persons.

What is claimed is:

1. A sound reproducing device comprising:

parametric speakers disposed to a display;

a loudspeaker disposed to the display, the loudspeaker having a wider directivity than the parametric speakers;

drivers disposed to the display for changing directions of the parametric speakers, respectively;

a human-body sensor disposed to the display; and a controller connected electrically to the parametric speakers, the loudspeaker, and the human-body sensor, wherein the parametric speakers and the drivers constitute at least two parametric speaker units disposed to the display, each of said at least two parametric speaker units being composed of respective one of the parametric speakers and respective one of the drivers, and wherein the controller switches between a control of changing directions of the parametric speakers for reproducing sound information and a control of allowing the loudspeaker for reproducing the sound information based on a number of persons in front of the display which is detected from an output of the human-body sensor, such that the controller is operable to:

control the drivers to follow the persons and reproduce sound information when the number of the persons is equal to or smaller than a number of the parametric speakers; and switch the reproducing of the sound information from the parametric speakers to the loudspeaker as to cause the loudspeaker to reproduce the sound information when the number of persons is greater than the number of the parametric speakers.

2. The sound reproducing device according to claim 1, wherein the loudspeaker comprises a plurality of loudspeakers disposed to the display.

3. The sound reproducing device according to claim 1, wherein the drivers can change directions of the parametric speakers horizontally and vertically.

4. The sound reproducing device according to claim 1, wherein, when the controller detects no person based on an output from the human-body sensor, the controller is operable to stop reproducing the sound information and stop an operation of the drivers.

5. The sound reproducing device according to claim 4, wherein, when the controller detects, based on an output from the human-body sensor, that the persons approach a front of the display while stopping reproducing the sound information, the controller is operable to increase a sound volume of the parametric speakers gradually to a predetermined sound volume while reproducing the sound information.

6. The sound reproducing device according to claim 1, wherein. when the controller detects, based on an output from the human-body sensor, that the persons approach the display by a predetermined distance, the controller is operable to cause the loudspeaker to reproduce the sound information.

7. The sound reproducing device according to claim 1, wherein the loudspeaker reproduce sound information different from sound information reproduced by the parametric speakers.

8. The sound reproducing device according to claim 1, further comprising an electricity storage section connected electrically to the parametric speakers, the loudspeaker, the drivers, the human-body sensor, and the controller, wherein the electricity storage section is charged by a utility power supply during no power outage of the utility power supply, and discharges electric power during a power outage of the utility power supply, and wherein the controller reproduces sound information for power outage.

9. The sound reproducing device according to claim 8, wherein the display includes a light source and displays video information supplied by the controller, and is connected electrically to the electricity storage section, and wherein the controller causes the display to display video information for power outage during the power outage.

10. The sound reproducing device according to claim 9, wherein, when electric power stored in the electricity storage section is equal to or smaller than a predetermined level, the controller is operable to:

stop reproducing the sound information for power outage and only display the video information for power outage on the display in a case that a light intensity obtained from the human-body sensor is equal to or smaller than a predetermined light intensity; and stop displaying the video information for power outage on the display and only reproduce the sound information for power outage in a case that the light intensity obtained from the human-body sensor is greater than the predetermined light intensity.

11. A sound reproducing device comprising:

parametric speakers disposed to a display;

a loudspeaker disposed to the display, the loudspeaker having a wider directivity than the parametric speakers;

drivers disposed to the display for changing directions of the parametric speakers;

a human-body sensor disposed to the display; and a controller connected electrically to the parametric speaker, the loudspeaker, and the human-body sensor, wherein the parametric speakers and the drivers constitute at least two parametric speaker units disposed to the display, each of said at least two parametric speaker units being composed of respective one of the parametric speakers and the drivers, wherein the controller performs a control of changing directions of the parametric speakers for reproducing sound information and a control of allowing the loudspeaker for reproducing the sound information based on a number of persons in front of the display which is detected from an output of the human-body sensor, such that the controller is operable to:

control the drivers to follow the persons and reproduce sound information when the number of persons is equal to or smaller than a number of the parametric speakers; and cause the parametric speakers and the loudspeaker to reproduce the sound information simultaneously when the number of persons is greater than the number of the parametric speakers.

12. The sound reproducing device according to claim 11, wherein the loudspeaker comprises a plurality of loudspeakers disposed to the display.

13. The sound reproducing device according to claim 11, wherein the drivers can change directions of the parametric speakers horizontally and vertically.

14. The sound reproducing device according to claim 11, wherein, when the controller detects no person based on an output from the human-body sensor, the controller is operable to stop reproducing the sound information and stop an operation of the drivers.

15. The sound reproducing device according to claim 14, wherein, when the controller detects, based on an output from the human-body sensor, that the persons approach a front of the display while stopping reproducing the sound information, the controller is operable to increase a sound volume of the parametric speakers gradually to a predetermined sound volume while reproducing the sound information.

16. The sound reproducing device according to claim 11, wherein. when the controller detects, based on an output from the human-body sensor, that the persons approach the display by a predetermined distance, the controller is operable to cause the loudspeaker to reproduce the sound information.

17. The sound reproducing device according to claim 11, wherein, when the number of persons obtained from an output from the human-body sensor is greater than the number of the parametric speakers, the controller is operable to repeat controlling the drivers to follow one of the persons and reproduces the sound information and then to follow another person of the persons and reproduces the sound information.

18. The sound reproducing device according to claim 17, wherein the controller detects firstly a person closest to the display among the persons.

19. The sound reproducing device according to claim 11, wherein the controller increases a sound volume of the loudspeaker while decreasing a sound volume of the parametric speakers.

20. The sound reproducing device according to claim 11, wherein the loudspeaker reproduce sound information different from sound information reproduced by the parametric speakers.

21. The sound reproducing device according to claim 11, further comprising an electricity storage section connected electrically to the parametric speakers, the loudspeaker, the drivers, the human-body sensor, and the controller, wherein the electricity storage section is charged by a utility power supply during no power outage of the utility power supply, and discharges electric power during a power outage of the utility power supply, and wherein the controller reproduces sound information for power outage.

22. The sound reproducing device according to claim 21, wherein the display includes a light source and displays video information supplied by the controller, and is connected electrically to the electricity storage section, and wherein the controller causes the display to display video information for power outage during the power outage.

23. The sound reproducing device according to claim 22, wherein, when electric power stored in the electricity storage section is equal to or smaller than a predetermined level, the controller is operable to:

stop reproducing the sound information for power outage and only display the video information for power outage on the display in a case that a light intensity obtained from the human-body sensor is equal to or smaller than a predetermined light intensity; and stop displaying the video information for power outage on the display and only reproduce the sound information for power outage in a case that the light intensity obtained from the human-body sensor is greater than the predetermined light intensity.

* * * * *